US009311886B2

(12) United States Patent
Ikeda et al.

(10) Patent No.: US 9,311,886 B2
(45) **Date of Patent: *Apr. 12, 2016**

(54) DISPLAY DEVICE INCLUDING SIGNAL PROCESSING UNIT THAT CONVERTS AN INPUT SIGNAL FOR AN INPUT HSV COLOR SPACE, ELECTRONIC APPARATUS INCLUDING THE DISPLAY DEVICE, AND DRIVE METHOD FOR THE DISPLAY DEVICE

(71) Applicant: Japan Display Inc., Tokyo (JP)

(72) Inventors: Kojiro Ikeda, Tokyo (JP); Fumitaka Goto, Tokyo (JP); Tae Nakahara, Tokyo (JP); Masashi Mitsui, Tokyo (JP); Amane Higashi, Tokyo (JP); Hiroki Uchiyama, Tokyo (JP); Toshiyuki Nagatsuma, Tokyo (JP); Hirokazu Tatsuno, Tokyo (JP); Masaaki Kabe, Tokyo (JP); Akira Sakaigawa, Tokyo (JP)

(73) Assignee: Japan Display Inc., Tokyo (JP)

( * ) Notice: Subject to any disclaimer, the term of this patent is extended or adjusted under 35 U.S.C. 154(b) by 176 days.

This patent is subject to a terminal disclaimer.

(21) Appl. No.: 14/073,443

(22) Filed: Nov. 6, 2013

(65) Prior Publication Data

US 2014/0125689 A1 May 8, 2014

(30) Foreign Application Priority Data

Nov. 7, 2012 (JP) ..... 2012-245505
Mar. 25, 2013 (JP) ..... 2013-063105

(51) Int. Cl.

| | |
|---|---|
| ***G09G 5/00*** | (2006.01) |
| ***G09G 3/36*** | (2006.01) |
| ***G09G 5/02*** | (2006.01) |

(52) U.S. Cl.
CPC ..... *G09G 5/02* (2013.01); *G09G 3/3648* (2013.01); *G09G 2300/0452* (2013.01); *G09G 2340/06* (2013.01)

(58) Field of Classification Search
CPC ..... G09G 5/02
See application file for complete search history.

(56) References Cited

U.S. PATENT DOCUMENTS

| | | | | |
|---|---|---|---|---|
| 2011/0181635 | A1* | 7/2011 | Kabe et al. | 345/694 |
| 2012/0050345 | A1* | 3/2012 | Higashi et al. | 345/690 |
| 2013/0027441 | A1* | 1/2013 | Kabe et al. | 345/690 |
| 2014/0267471 | A1* | 9/2014 | Harada et al. | 345/694 |

FOREIGN PATENT DOCUMENTS

| | | |
|---|---|---|
| JP | 2010-033009 | 2/2010 |
| JP | 2011-154323 | 8/2011 |
| JP | 2011-248352 | 12/2011 |

* cited by examiner

*Primary Examiner* — Joni Richer
*Assistant Examiner* — Grace Q Li
(74) *Attorney, Agent, or Firm* — K&L Gates LLP

(57) ABSTRACT

According to an aspect, a display device includes an image display panel on which pixels each including sub-pixels for displaying a first color, a second color, a third color, and a fourth color are arranged, and a signal processing unit that converts an input value of an input signal for an input HSV color space into an output signal for an extended HSV color space. The signal processing unit divides the extended HSV color space into a plurality of spaces, sets limit proportion values different from each other with respect to at least two spaces of the divided spaces respectively, calculates an extension coefficient α with respect to the input signal by using the input signal and a limit proportion value set with respect to a space according to the input signal, and calculates the output signal based on at least the input signal and the extension coefficient α.

12 Claims, 8 Drawing Sheets

DISPLAY DEVICE INCLUDING SIGNAL PROCESSING UNIT THAT CONVERTS AN INPUT SIGNAL FOR AN INPUT HSV COLOR SPACE, ELECTRONIC APPARATUS INCLUDING THE DISPLAY DEVICE, AND DRIVE METHOD FOR THE DISPLAY DEVICE

CROSS REFERENCES TO RELATED APPLICATIONS

The present application claims priority to Japanese Priority Patent Application JP 2012-245505 filed in the Japan Patent Office on Nov. 7, 2012, JP 2013-063105 filed in the Japan Patent Office on Mar. 25, 2013, the entire content of which is hereby incorporated by reference.

BACKGROUND

1. Technical Field

The present disclosure relates to a display device and a drive method for the same. The present disclosure also relates to an electronic apparatus with the display device.

2. Description of the Related Art

Recently, there is a growing need for display devices optimized for, for example, mobile devices such as mobile phones and electronic papers. The display device is configured that one pixel has a plurality of sub-pixels, each of which emits light in a different color, and a display of the sub-pixel is turned on or off, to thereby display various colors using one pixel. Some of the display devices include those in which four sub-pixels including white are made to one pixel (see Japanese Patent Application Laid-open Publication No. 2010-33009 (JP-A-2010-33009) and Japanese Patent Application Laid-open Publication No. 2011-248352 (JP-A-2011-248352)).

JP-A-2010-33009 describes a display device that includes an image display panel on which pixels each including first, second, third, and fourth sub-pixels are arranged in a two-dimensional matrix and a signal processing unit that receives an input signal and outputs an output signal. The display device can enlarge an HSV (Hue, Saturation, Value) color space more than three primary colors by adding a fourth color to the three primary colors. The signal processing unit stores therein a maximum value $V_{max}(S)$ of a value (brightness) based on a saturation S functioning as a variable, calculates the saturation S and the brightness V(S) based on the signal value of the input signal, calculates an extension coefficient $\alpha_0$ based on at least one of values of $V_{max}(S)/V(S)$, calculates an output signal value for the fourth sub-pixel based on at least input signal values for the first, the second, and the third sub-pixels, and calculates output signal values for the first, the second, and the third sub-pixels based on the input signal values, the extension coefficient $\alpha_0$, and the output signal value for the fourth sub-pixel.

JP-A-2011-248352 describes a display device that includes a display panel on which a plurality of pixels each having sub-pixels with red, green, and blue color filters and a sub-pixel for controlling transmission of white light are provided; a backlight unit including red, green, blue, and white light sources; an image switching circuit for switching whether to display the display panel in a moving image mode or in a still image mode; and a display control circuit that controls respective luminance of red, green, and blue in the backlight unit according to an image signal in the moving image mode and controls luminance of a white light source in the backlight unit according to an image signal in the still image mode. Japanese Patent Application Laid-open Publication No. 2011-154323 (JP-A-2011-154323) describes a display device in which a signal processing unit calculates a saturation S and a brightness V(S) of a plurality of pixels based on input signal values of sub-pixels in the plurality of pixels, and determines an extension coefficient $\alpha_0$ so that a proportion of pixels, each of which a value of the extended brightness calculated from a product of the brightness V(S) and the extension coefficient $\alpha_0$ exceeds the maximum value $V_{max}(S)$, to all the pixels becomes a predetermined value ($\beta_0$) or less.

As described in JP-A-2010-33009, JP-A-2011-248352, and JP-A-2011-154323, an image signal is extended corresponding to an HSV area enlarged by using one sub-pixel (basically, a white sub-pixel) among the sub-pixels based on the image signals to thereby decrease the light amount of the light source, thus reproducing a desired image. Moreover, an image can be made bright without increasing the light amount of the light source.

However, there may be a case in which extension of the image signal causes the image quality to lower (degrade). On the other hand, there may be a case in which the display device described in JP-A-2011-154323 is used to determine the extension coefficient and this thereby enables to suppress degradation of the image quality but reduction of power consumption becomes less effective.

SUMMARY

According to an aspect, a display device includes an image display panel on which pixels each including a first sub-pixel for displaying a first color, a second sub-pixel for displaying a second color, a third sub-pixel for displaying a third color, and a fourth sub-pixel for displaying a fourth color are arranged in a two-dimensional matrix, and a signal processing unit that converts an input value of an input signal for an input HSV color space into an output signal for an extended HSV color space extended by the first color, the second color, the third color, and the fourth color to generate an output signal, and outputs the generated output signal to the image display panel. The signal processing unit divides the extended HSV color space into a plurality of spaces based on at least one of a saturation, a brightness, and a hue, and sets limit proportion values different from each other with respect to at least two spaces of the divided spaces respectively, each of the limit proportion values being an upper limit of a proportion of a range exceeding a maximum value of the brightness to the maximum value in the extended HSV color space in a combination of values of the hue and the saturation, calculates an extension coefficient $\alpha$ with respect to the input signal within a range in which a first value does not exceed a second value, the first value being a value among values obtained by multiplying the brightness of a signal of each of the sub-pixels of the input signal by the extension coefficient $\alpha$, the first value exceeding the maximum value of the brightness, the second value being a value obtained by multiplying the maximum value of the brightness by a limit proportion value set with respect to a space according to the input signal, calculates an output signal of the first sub-pixel based on at least the input signal of the first sub-pixel and the extension coefficient $\alpha$, and outputs the calculated output signal to the first sub-pixel, calculates an output signal of the second sub-pixel based on at least the input signal of the second sub-pixel and the extension coefficient $\alpha$, and outputs the calculated output signal to the second sub-pixel, calculates an output signal of the third sub-pixel based on at least the input signal of the third sub-pixel and the extension coefficient $\alpha$, and outputs the calculated output signal to the third sub-pixel, and calculates an output signal of the fourth sub-pixel based on the input signal of the first sub-pixel, the input signal of the second sub-pixel, and the input signal of the third sub-pixel, and outputs the calculated output signal to the fourth sub-pixel.

According to another aspect, an electronic apparatus includes a display device; and a control device. The display device includes an image display panel on which pixels each including a first sub-pixel for displaying a first color, a second sub-pixel for displaying a second color, a third sub-pixel for displaying a third color, and a fourth sub-pixel for displaying a fourth color are arranged in a two-dimensional matrix, and a signal processing unit that converts an input value of an input signal for an input HSV color space into an output signal for an extended HSV color space extended by the first color, the second color, the third color, and the fourth color to generate an output signal, and outputs the generated output signal to the image display panel. The signal processing unit divides the extended HSV color space into a plurality of spaces based on at least one of a saturation, a brightness, and a hue, and sets limit proportion values different from each other with respect to at least two spaces of the divided spaces respectively, each of the limit proportion values being an upper limit of a proportion of a range exceeding a maximum value of the brightness to the maximum value in the extended HSV color space in a combination of values of the hue and the saturation, calculates an extension coefficient $\alpha$ with respect to the input signal within a range in which a first value does not exceed a second value, the first value being a value among values obtained by multiplying the brightness of a signal of each of the sub-pixels of the input signal by the extension coefficient $\alpha$, the first value exceeding the maximum value of the brightness, the second value being a value obtained by multiplying the maximum value of the brightness by a limit proportion value set with respect to a space according to the input signal, calculates an output signal of the first sub-pixel based on at least the input signal of the first sub-pixel and the extension coefficient $\alpha$, and outputs the calculated output signal to the first sub-pixel, calculates an output signal of the second sub-pixel based on at least the input signal of the second sub-pixel and the extension coefficient $\alpha$, and outputs the calculated output signal to the second sub-pixel, calculates an output signal of the third sub-pixel based on at least the input signal of the third sub-pixel and the extension coefficient $\alpha$, and outputs the calculated output signal to the third sub-pixel, and calculates an output signal of the fourth sub-pixel based on the input signal of the first sub-pixel, the input signal of the second sub-pixel, and the input signal of the third sub-pixel, and outputs the calculated output signal to the fourth sub-pixel. The control device supplies the input signal to the display device.

According to another aspect, a drive method of a display device including an image display panel on which pixels each including a first sub-pixel for displaying a first color, a second sub-pixel for displaying a second color, a third sub-pixel for displaying a third color, and a fourth sub-pixel for displaying a fourth color are arranged in a two-dimensional matrix, and a signal processing unit that converts an input value of an input signal for an input HSV color space into an output signal for an extended HSV color space extended by the first color, the second color, the third color, and the fourth color to generate an output signal, and outputs the generated output signal to the image display panel, includes: dividing the extended HSV color space into a plurality of spaces based on at least one of a saturation, a brightness, and a hue, and setting limit proportion values different from each other with respect to at least two spaces of the divided spaces respectively, each of the limit proportion values being an upper limit of a proportion of a range exceeding a maximum value of the brightness to the maximum value in the extended HSV color space in a combination of values of the hue and the saturation; calculating an extension coefficient $\alpha$ with respect to the input signal within a range in which a first value does not exceed a second value, the first value being a value among values obtained by multiplying the brightness of a signal of each of the sub-pixels of the input signal by the extension coefficient $\alpha$, the first value exceeding the maximum value of the brightness, the second value being a value obtained by multiplying the maximum value of the brightness by a limit proportion value set with respect to a space according to the input signal; calculating an output signal of the first sub-pixel based on at least the input signal of the first sub-pixel and the extension coefficient $\alpha$, and outputting the calculated output signal to the first sub-pixel; calculating an output signal of the second sub-pixel based on at least the input signal of the second sub-pixel and the extension coefficient $\alpha$, and outputting the calculated output signal to the second sub-pixel; calculating an output signal of the third sub-pixel based on at least the input signal of the third sub-pixel and the extension coefficient $\alpha$, and outputting the calculated output signal to the third sub-pixel; and calculating an output signal of the fourth sub-pixel based on the input signal of the first sub-pixel, the input signal of the second sub-pixel, and the input signal of the third sub-pixel, and outputting the calculated output signal to the fourth sub-pixel.

Additional features and advantages are described herein, and will be apparent from the following Detailed Description and the figures.

DETAILED DESCRIPTION

An Embodiment for implementing the present disclosure will be explained in detail below with reference to the accompanying drawings. The explanation is given in the following order.

1. Embodiment (Display device and Drive method of the display device)

providing each pixel with sub-pixels including a white sub-pixel

Calculation of an extension coefficient based on an input signal, and generation of an output signal based on the extension coefficient Division of an extended HSV color space into a plurality of spaces, and setting of a limit proportion value with respect to each space 2. Application Example (Electronic apparatus)

An example of applying the display device according to the embodiment to the electronic apparatus 3. Aspects of Disclosure

1. Embodiment

Figure 1:
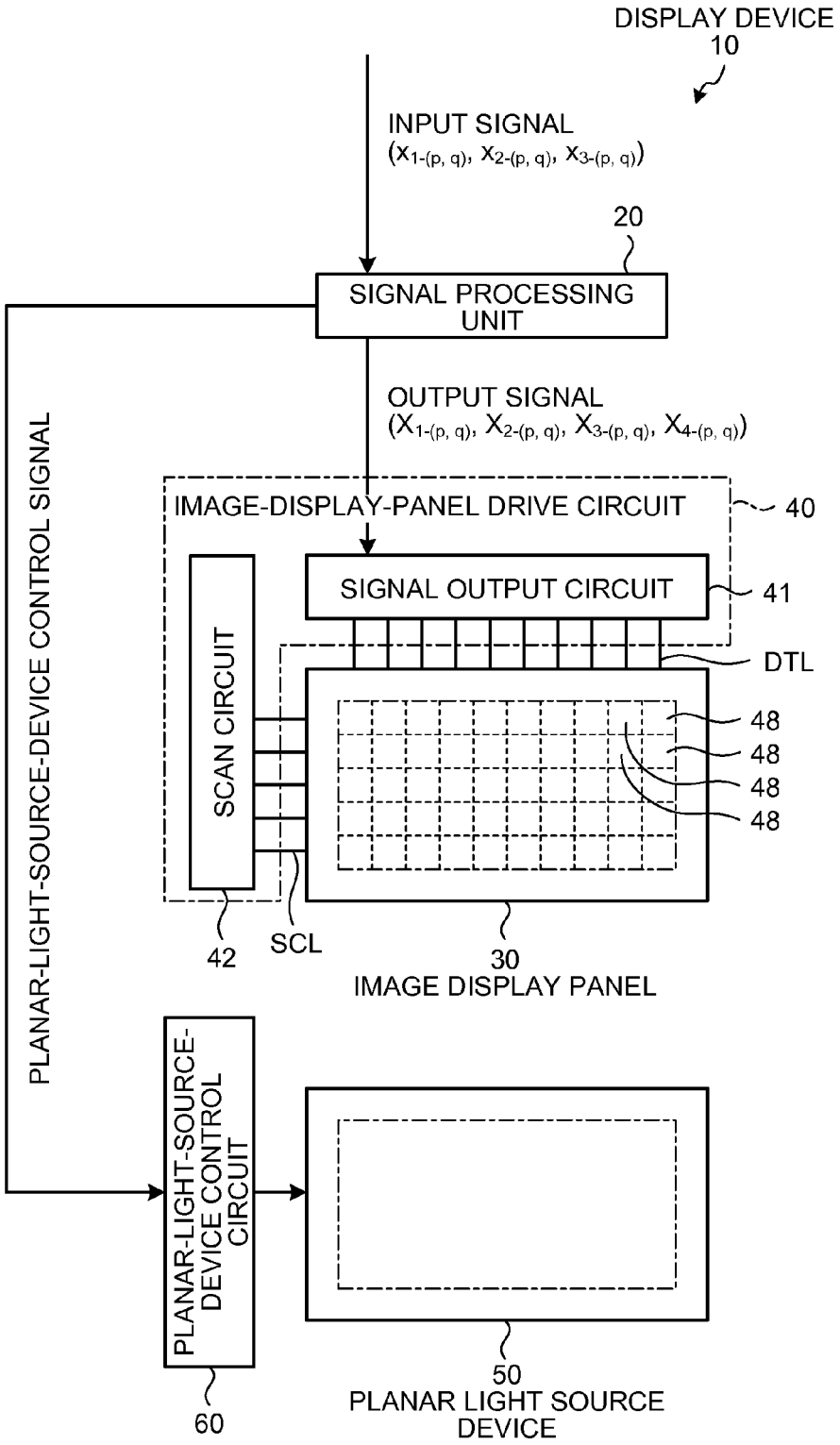
FIG. 1 is a block diagram of an example of a configuration of a display device according to an embodiment of the present disclosure.
Figure 2:
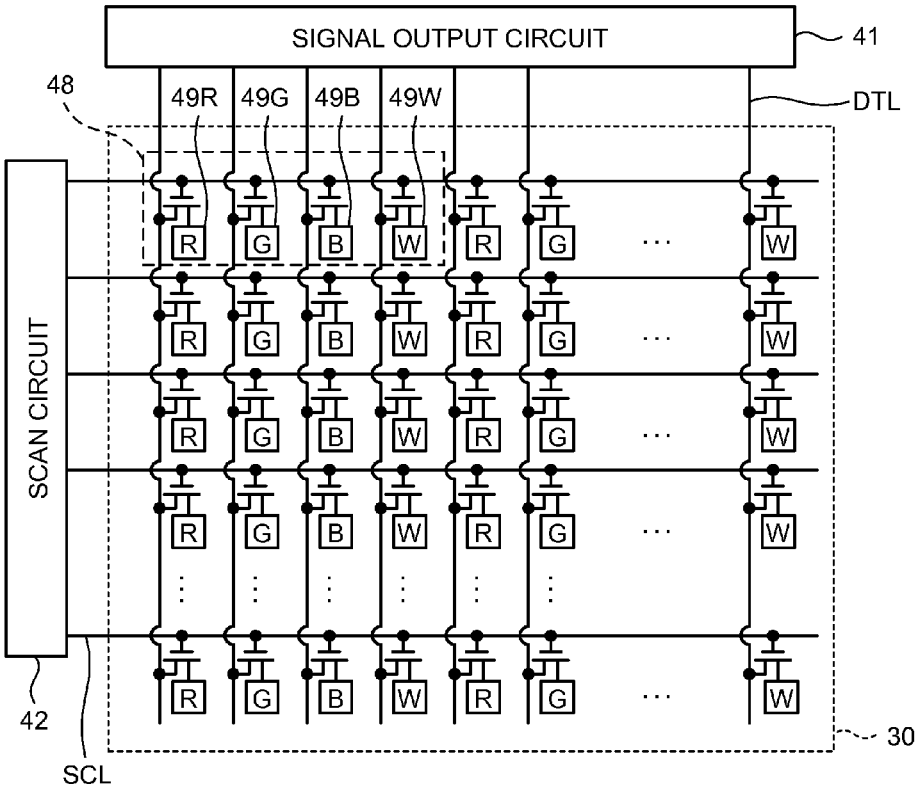
FIG. 2 is a conceptual diagram of an image display panel and an image-display-panel drive circuit in the display device illustrated in FIG. 1.

FIG. 1 is a block diagram of an example of a configuration of a display device according to an embodiment of the present disclosure. FIG. 2 is a conceptual diagram of an image display panel and an image-display-panel drive circuit in the display device illustrated in FIG. 1. As illustrated in FIG. 1, a display device 10 according to the embodiment includes a signal processing unit 20 that transmits a signal to units of the display device 10 and controls operations of the units, an image display panel 30 for displaying an image based on an output signal output from the signal processing unit 20, an image-display-panel drive circuit 40 that controls the drive of the image display panel 30, a planar light source device 50 for lighting up the image display panel 30 from its back face, and a planar-light-source-device control circuit 60 that controls the drive of the planar light source device 50. The display device 10 has the same configuration as that of an image display device assembly described in JP-A-2011-154323, and various modifications described in JP-A-2011-154323 are applicable to the display device 10.

The signal processing unit 20 is an arithmetic processing unit that controls the operations of the image display panel 30 and the planar light source device 50. The signal processing unit 20 is connected to the image-display-panel drive circuit 40 for driving the image display panel 30 and to the planar-light-source-device control circuit 60 for driving the planar light source device 50. The signal processing unit 20 processes the input signal input from an external device to generate an output signal and a planar-light-source-device control signal. That is, the signal processing unit 20 converts an input value (input signal) of the input signal for an input HSV color space into an extended value (output signal) for an extended HSV color space extended by a first color, a second color, a third color, and a fourth color to generate an output signal, and outputs the generated output signal to image display panel 30. The signal processing unit 20 outputs the generated output signal to the image-display-panel drive circuit 40, and outputs the generated planar-light-source-device control signal to the planar-light-source-device control circuit 60.

The image display panel 30 has, as illustrated in FIG. 2, pixels 48 each including a first sub-pixel R displaying a first primary color (e.g., red), a second sub-pixel G displaying a second primary color (e.g., green), a third sub-pixel B displaying a third primary color (e.g., blue), and a fourth sub-pixel W displaying a fourth primary color (specifically, white), the pixels 48 being arranged in a two-dimensional matrix of $P_0 \times Q_0$ ($P_0$ pieces in a horizontal direction and $Q_0$ pieces in a vertical direction).

More specifically, the display device according to the embodiment is a transmissive color liquid crystal display device. The image display panel 30 is a color liquid crystal display panel, and includes a first color filter for passing the first primary color therethrough arranged between a first sub-pixel 49R and an image observer, a second color filter for passing the second primary color therethrough arranged between a second sub-pixel 49G and the image observer, and a third color filter for passing the third primary color therethrough arranged between a third sub-pixel 49B and the image observer. The image display panel 30 includes no color filter between a fourth sub-pixel 49W and the image observer. Instead of the color filter, a transparent resin layer may be provided in the fourth sub-pixel 49W. In this way, by providing the transparent resin layer, the image display panel 30 can prevent a sharp step occurring in the fourth sub-pixel 49W due to no color filter provided in the fourth sub-pixel 49W.

In the example of FIG. 2, the first sub-pixel 49R, the second sub-pixel 49G, the third sub-pixel 49B, and the fourth sub-pixel 49W are arranged on the image display panel 30 in an array similar to a stripe array. The structure of sub-pixels included in one pixel and their arrangement are not particularly limited. The first sub-pixel 49R, the second sub-pixel 49G, the third sub-pixel 49B, and the fourth sub-pixel 49W may be arranged in an array similar to a diagonal array (mosaic array) on the image display panel 30. In addition, for example, they may be arranged in an array similar to a delta array (triangular array) or in an array similar to a rectangular array. The array similar to the stripe array is generally suitable for displaying data and character strings on a personal computer and the like. On the other hand, the array similar to the mosaic array is suitable for displaying natural images on a video camera recorder, a digital still camera, and the like.

The image-display-panel drive circuit 40 includes a signal output circuit 41 and a scan circuit 42. The image-display-panel drive circuit 40 causes the signal output circuit 41 to hold video signals and sequentially output a video signal to the image display panel 30. The signal output circuit 41 is electrically connected to the image display panel 30 through a line DTL. The image-display-panel drive circuit 40 causes the scan circuit 42 to control on/off of a switching element (e.g., TFT) for controlling operations (light transmission rate) of the sub-pixels on the image display panel 30. The scan circuit 42 is electrically connected to the image display panel 30 through a line SCL.

The planar light source device 50 is provided on the back face of the image display panel 30, and radiates light to the image display panel 30 to thereby light up the image display panel 30. The planar light source device 50 radiates light over the entire surface of the image display panel 30 to light up the image display panel 30. The planar-light-source-device control circuit 60 controls, for example, the light amount of light output from the planar light source device 50. Specifically, the planar-light-source-device control circuit 60 controls a voltage or so to be supplied to the planar light source device 50 based on the planar-light-source-device control signal output from the signal processing unit 20, to thereby control the light amount (light intensity) of the light radiated to the image display panel 30.

Figure 3:
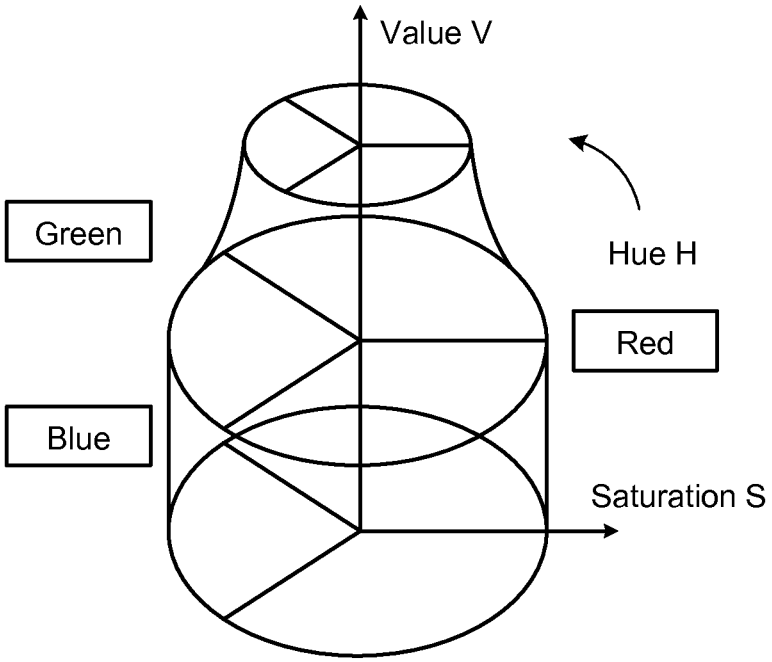
FIG. 3 is a conceptual diagram of an extended HSV color space reproducible by the display device according to the embodiment.
Figure 4:
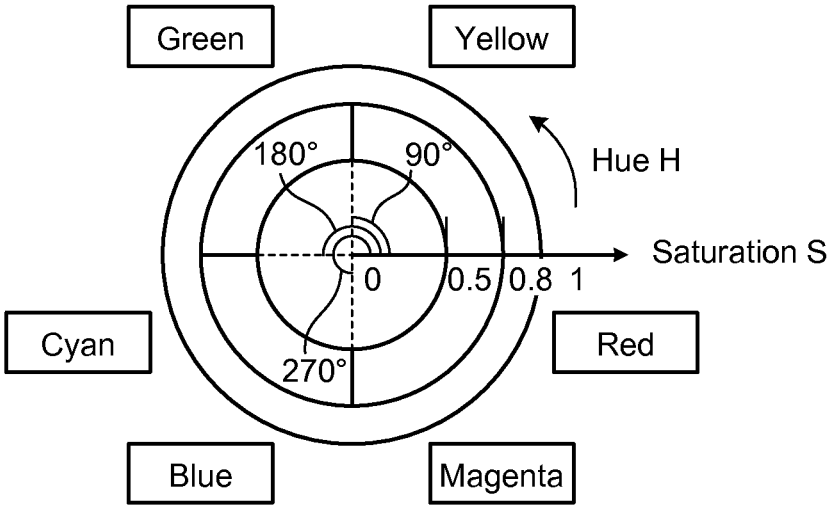
FIG. 4 is a conceptual diagram of a relation between hue and saturation in the extended HSV color space.
Figure 5:
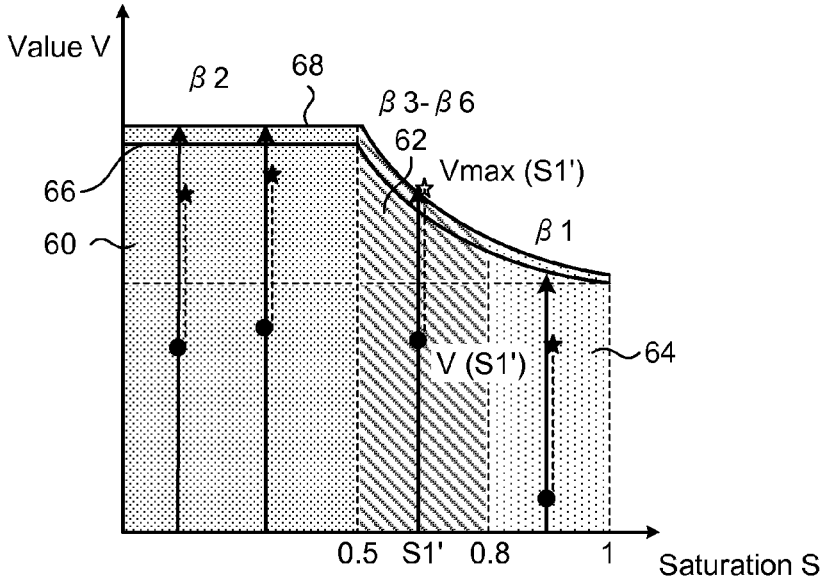
FIG. 5 is a conceptual diagram of a relation between the saturation and value (brightness) in the extended HSV color space.
Figure 6:
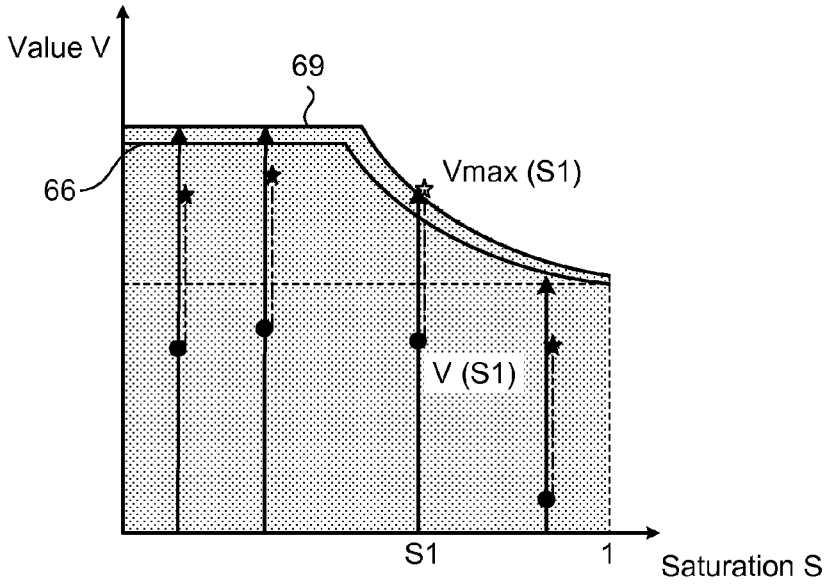
FIG. 6 is a conceptual diagram of a relation between the saturation and the brightness in the extended HSV color space in which the space is not divided.

Processing operations executed by the signal processing unit 20 will be explained below with reference to FIG. 3 to FIG. 6. FIG. 3 is a conceptual diagram of an extended HSV color space reproducible by the display device according to the embodiment. FIG. 4 is a conceptual diagram of a relation between hue and saturation in the extended HSV color space. FIG. 5 is a conceptual diagram of a relation between the saturation and value (brightness) in the extended HSV color space. FIG. 6 is a conceptual diagram of a relation between the saturation and the brightness in the extended HSV color space in which the space is not divided.

An input signal, which is information for an image to be displayed from an external device, is input to the signal processing unit 20. The input signal includes information of an image (color), as an input signal, displayed at the position for each pixel. Specifically, for a (p, q)-th pixel (provided that $1 \leq p \leq P_0$, $1 \leq q \leq Q_0$), a signal including an input signal of the first sub-pixel whose signal value is $x_{1-(p,q)}$, an input signal of the second sub-pixel whose signal value is $x_{2-(p,q)}$, and an input signal of the third sub-pixel whose signal value is $x_{3-(p,q)}$ is input to the signal processing unit 20.

The signal processing unit 20 processes the input signals to thereby generate an output signal (signal value $X_{1-(p,q)}$) of the first sub-pixel for determining a display gradation of the first sub-pixel 49R, an output signal (signal value $X_{2-(p,q)}$) of the second sub-pixel for determining a display gradation of the second sub-pixel 49G, an output signal (signal value $X_{3-(p,q)}$) of the third sub-pixel for determining a display gradation of the third sub-pixel 49B, and an output signal (signal value $X_{4-(p,q)}$) of the fourth sub-pixel for determining a display gradation of the fourth sub-pixel 49W, and outputs the generated output signals to the image-display-panel drive circuit 40.

The display device 10 provides the fourth sub-pixel 49W for outputting the fourth color (white) in the pixel 48, so that a dynamic range of the brightness in the HSV color space (extended HSV color space) is enlarged as illustrated in FIG. 3. In other words, as illustrated in FIG. 3, the shape is such that a solid body is placed on the cylindrical HSV color space capable of representing the first sub-pixel, the second sub-pixel, and the third sub-pixel. The shape of the solid body in a cross section along a saturation axis and a brightness axis is a substantially trapezoidal shape with curved oblique sides such that a maximum value of the brightness becomes lower as the saturation becomes higher. The signal processing unit 20 stores therein maximum values Vmax(S) of the brightness based on the saturation S functioning as a variable in the HSV color space enlarged by adding the fourth color (white). That is, the signal processing unit 20 stores values of the maximum value Vmax(S) of the brightness for each coordinates (values) of the saturation and the hue for the three-dimensional shape of the HSV color space as illustrated in FIG. 3. The input signal includes the input signals of the first sub-pixel 49R, the second sub-pixel 49G, and the third sub-pixel 49B, and therefore the HSV color space of the input signals has a cylindrical shape, i.e., a shape the same as the cylindrical shape portion of the extended HSV color space.

Subsequently, the signal processing unit 20 calculates an output signal (signal value $X_{1-(p,q)}$) of the first sub-pixel based on at least the input signal (signal value $X_{1-(p,q)}$) of the first sub-pixel and the extension coefficient α, and outputs the calculated output signal to the first sub-pixel 49R. The signal processing unit 20 calculates an output signal (signal value $X_{2-(p,q)}$) of the second sub-pixel based on at least the input signal (signal value $x_{2-(p,q)}$) of the second sub-pixel and the extension coefficient α, and outputs the calculated output signal to the second sub-pixel 49G. The signal processing unit 20 calculates an output signal (signal value $X_{3-(p,q)}$) of the third sub-pixel based on at least the input signal (signal value $x_{3-(p,q)}$) of the third sub-pixel and the extension coefficient α, and outputs the calculated output signal to the third sub-pixel 49B. The signal processing unit 20 calculates an output signal (signal value $X_{4-(p,q)}$) of the fourth sub-pixel based on the input signal (signal value $x_{1-(p,q)}$) of the first sub-pixel, the input signal (signal value $x_{2-(p,q)}$) of the second sub-pixel, and the input signal (signal value $x_{3-(p,q)}$) of the third sub-pixel, and outputs the calculated output signal to the fourth sub-pixel 49W.

Specifically, the signal processing unit 20 calculates the output signal of the first sub-pixel based on the input signal of the first sub-pixel, the extension coefficient α, and the output signal of the fourth sub-pixel, calculates the output signal of the second sub-pixel based on the input signal of the second sub-pixel, the extension coefficient α, and the output signal of the fourth sub-pixel, and calculates the output signal of the third sub-pixel based on the input signal of the third sub-pixel, the extension coefficient α, and the output signal of the fourth sub-pixel.

In other words, when χ is set as a constant dependent on the display device, the signal processing unit 20 calculates the output signal value $X_{1-(p,q)}$ of the first sub-pixel, the output signal value $X_{2-(p,q)}$ of the second sub-pixel, and the output signal value $X_{3-(p,q)}$ of the third sub-pixel for the $_{(p,q)}$-th pixel (or, a group of the first sub-pixel 49R, the second sub-pixel 49G, and the third sub-pixel 49B) from the following equations.

$$X_{1-(p,q)}=\alpha x_{1-(p,q)}-\chi X_{4-(p,q)} \tag{1-1}$$

$$X_{2-(p,q)}=\alpha X_{2-(p,q)}-\chi X_{4-(p,q)} \tag{1-2}$$

$$X_{3-(p,q)}=\alpha X_{3-(p,q)}-\chi X_{4-(p,q)} \tag{1-3}$$

The signal processing unit 20 calculates the maximum value Vmax(S) of the brightness based on the saturation S functioning as a variable in the HSV color space enlarged by adding the fourth color thereto, calculates the saturation S and the brightness V(S) in a plurality of pixels based on the input signal values of the sub-pixels in the pixels, and determines the extension coefficient α so that a proportion of pixels, each in which the value of the extended brightness calculated from a product of the brightness V(S) and the extension coefficient α exceeds the maximum value Vmax(S), to all the pixels becomes a limit proportion value β or less. That is, the signal processing unit 20 determines the extension coefficient α within a range in which a value exceeding the maximum value of the brightness, of values of the extended brightness, does not exceed a value obtained by multiplying the maximum value Vmax(S) by the limit proportion value β. The limit proportion value β herein is an upper limit value (proportion) of a proportion of pixels, each in which the value of the extended brightness exceeds a maximum value of the brightness to the maximum value in the extended HSV color space in a combination of the values of the hue and the saturation.

The saturation S and the brightness V(S) are expressed by S=(Max−Min)/Max and V(S)=Max. The saturation S can have a value in a range 0 to 1, and the brightness V(S) can have a value in a range 0 to $(2^{n-1})$ where n is the number of display gradation bits. Max is a maximum value of input signal values of the three sub-pixels, which are the input signal value of the first sub-pixel for the pixel, the input signal value of the second sub-pixel for the pixel, and the input signal value of the third sub-pixel for the pixel. Min is the minimum value of the input signal values of the three sub-pixels, which are the input signal value of the first sub-pixel for the pixel, the input signal value of the second sub-pixel for the pixel, and the input signal value of the third sub-pixel for the pixel. Hue H is expressed in degrees from 0° to 360° as illustrated in FIG. 4. The colors vary from Red, through Yellow, Green, Cyan, Blue, and Magenta, back to Red, along 0° to 360°. In the embodiment, a range including an angle of 0° is Red, a range including an angle of 120° is Green, and a range including an angle of 240° is Blue.

The signal processing unit 20 divides the HSV color space (extended HSV color space) illustrated in FIG. 3 into a plurality of spaces (color spaces) based on at least one of the saturation S, the hue H, and the brightness V, and sets a limit proportion value β with respect to each of the divided spaces.

For example, as illustrated in FIG. 4 and FIG. 5, the signal processing unit 20 sets a limit proportion value β1 of a space as 0.01 (1%), the space being included in a range in which the hue H is 0°≤H<360°, the saturation S is 0.8≤S, and the brightness V is 0≤V≤Max. The signal processing unit 20 sets a limit proportion value β2 of a space as 0.01 (1%), the space being included in a range in which the hue H is 0°≤H<360°, the saturation S is S≤0.5, and the brightness V is 0≤V≤Max. The signal processing unit 20 sets a limit proportion value β3 of a space as 0.025 (2.5%), the space being included in a range in which the hue H is 0°≤H<90°, the saturation S is 0.5<S<0.8, and the brightness V is 0≤V≤Max. The signal processing unit 20 sets a limit proportion value β4 of a space as 0.025 (2.5%), the space being included in a range in which the hue H is 90°≤H<180°, the saturation S is 0.5<S<0.8, and the brightness V is 0≤V≤Max. The signal processing unit 20 sets a limit proportion value β5 of a space as 0.025 (2.5%), the space being included in a range in which the hue H is 180°≤H<270°, the saturation S is 0.5<S<0.8, and the brightness V is 0≤V≤Max. The signal processing unit 20 sets a limit proportion value β6 of a space as 0.025 (2.5%), the space being included in a range in which the hue H is 270°≤H<360°, the saturation S is 0.5<S<0.8, and the brightness V is 0≤V≤Max.

In other words, in the embodiment, the limit proportion value β is set as a different value depending on the case in which the saturation S is included in 0.5<S<0.8 and the case in which the saturation S is not included in 0.5<S<0.8 (i.e., S≤0.5 or 0.8≤S). Therefore, as illustrated in FIG. 5, there is a relation of a space 60 of S≤0.5, a space 62 of 0.5<S<0.8, or a space 64 of 0.8≤S to a limit value line 68 indicating the limit value with respect to a maximum value line 66 indicating the maximum value of the brightness V, and the relation varies respectively. This enables the signal processing unit 20 to make the limit value line 68 different from a limit value line 69 obtained when the limit proportion value β in the HSV color space is made constant as illustrated in FIG. 6.

In FIG. 5 and FIG. 6, a circle sign represents a value of an input signal, and a star sign represents a value after the extension. In the example of FIG. 5, an extension coefficient α' when a brightness V(S1') corresponding to a value S1' of the saturation is Vmax(S1') as a value on the limit value line 68 is determined as an extension coefficient of the image. In the example of FIG. 6, the extension coefficient α when a brightness V(S1) corresponding to a value S1 of the saturation is Vmax(S1) as a value on the limit value line 69 is determined as an extension coefficient of the image.

The signal processing unit 20 sets the limit proportion value β to different values depending on the spaces and can thereby extend the signal to a more appropriate one. For example, by reducing the limit proportion value of a space that has a significant effect on image quality and by increasing the limit proportion value of a space that has a less effect on image quality, it is possible to increase the extension coefficient while maintaining the image quality. For example, as represented in the embodiment, by reducing the limit proportion value of a space in which S is close to 1 (0.8≤S in the embodiment) to a value lower than the limit proportion value of a space (S<0.8) in which S is lower, the signal processing unit 20 can set an extension coefficient in other ranges to be high while maintaining the image quality of a highly colored range in which a color change is highly visible to human eyes. By reducing the limit proportion value of a space in which S is close to 0 (S≤0.5 in the embodiment) to a value lower than a limit proportion value of a space (0.5<S) in which S is higher, the signal processing unit 20 can set an extension coefficient in other ranges to be high while maintaining the image quality of an achromatic range in which a gradation change is highly visible to human eyes.

In the embodiment, the signal value $X_{4-(p,q)}$ can be calculated based on a product of $Min_{(p,q)}$ and the extension coefficient α. Specifically, it can be calculated based on the following equation.

$$X_{4-(p,q)}=Min_{(p,q)}\cdot\alpha/\chi \tag{11}$$

In Equation (11), the product of $Min_{(p,q)}$ and the extension coefficient α is divided by χ; however, the embodiment is not limited thereto. In addition, the extension coefficient α is determined for each image display frame.

These points are explained below.

In general, a saturation $S_{(p,q)}$ and a brightness $V(S)_{(p,q)}$ in the cylindrical HSV color space in the $_{(p,q)}$-th pixel can be calculated from the following equations based on the input signal (signal value $x_{1-(p,q)}$) of the first sub-pixel, the input signal (signal value $x_{2-(p,q)}$) of the second sub-pixel, and the input signal (signal value $x_{3-(p,q)}$) of the third sub-pixel.

$$S_{(p,q)}=(Max_{(p,q)}-Min_{(p,q)})/Max_{(p,q)} \tag{12-1}$$

$$V(S)_{(p,q)}=Max_{(p,q)} \tag{12-2}$$

$Max_{(p,q)}$ is the maximum value of the input signal values of the three sub-pixels ($x_{1-(p,q)}$, $x_{2-(p,q)}$, $x_{3-(p,q)}$), and $Min_{(p,q)}$ is the minimum value of the input signal values of the three sub-pixels ($x_{1-(p,q)}$, $x_{2-(p,q)}$, $x_{3-(p,q)}$). In the embodiment, it is determined that n=8. In other words, the number of display gradation bits is determined as 8 bits (value of display gradation is 256 gradation from 0 to 255).

No color filter is provided on the fourth sub-pixel 49W for displaying white. It is assumed that a luminance of a set of the first sub-pixel 49R, the second sub-pixel 49G, and the third sub-pixel 49B forming a pixel or a pixel group is determined as $BN_{1-3}$ when a signal having a value corresponding to a maximum signal value of the output signal of the first sub-pixel is input to the first sub-pixel 49R, when a signal having a value corresponding to a maximum signal value of the output signal of the second sub-pixel is input to the second sub-pixel 49G, and when a signal having a value corresponding to a maximum signal value of the output signal of the third sub-pixel is input to the third sub-pixel 49B. It is also assumed that a luminance of the fourth sub-pixel 49W is determined as $BN_4$ when a signal having a value corresponding to a maximum signal value of the output signal of the fourth sub-pixel is input to the fourth sub-pixel 49W forming the pixel or the pixel group. In other words, white with the maximum luminance is displayed by the set of the first sub-pixel 49R, the second sub-pixel 49G, and the third sub-pixel 49B, and the luminance of the white is expressed by $BN_{1-3}$. Then, a constant χ is expressed by $\chi=BN_4/BN_{1-3}$ where χ is a constant dependent on the display device.

Specifically, assuming that an input signal having a value 255 of display gradation is input to the fourth sub-pixel 49W, the luminance $BN_4$ is, for example, 1.5 times higher than the luminance $BN_{1-3}$ of the white when input signals having the following values of display gradation: $x_{1-(p,q)}=255$, $x_{2-(p,q)}=255$, and $x_{3-(p,q)}=255$ are input to the set of the first sub-pixel 49R, the second sub-pixel 49G, and the third sub-pixel 49B. In other words, $\chi=1.5$ in the embodiment.

Incidentally, when the signal value $X_{4-(p,\ q)}$ is given by Equation (11), Vmax(S) can be expressed by the following equations.

When $S \leq S_0$:

$$V\max(S)=(\chi+1)\cdot(2^n-1) \tag{13-1}$$

When $S_0<S\leq 1$:

$$V\max(S)=(2^n-1)\cdot(1/S) \tag{13-2}$$

where $S_0=1/(\chi+1)$.

The maximum values Vmax(S) of the brightness, obtained in the above manner, based on the saturation S functioning as a variable in the HSV color space enlarged by adding the fourth color are stored as a kind of lookup table in, for example, the signal processing unit 20, or the maximum value Vmax(S) of the brightness is calculated by the signal processing unit 20 in each case.

How to calculate output signal values $X_{1-(p,\ q)}$, $X_{2-(p,\ q)}$, $X_{3-(p,q)}$, and $X_{4-(p,\ q)}$ in a $_{(p,q)}$-th pixel (extension process) will be explained below. The following processes are performed so as to keep a ratio among the luminance of the first primary color displayed by (first sub-pixel 49R+fourth sub-pixel 49W), the luminance of the second primary color displayed by (second sub-pixel 49G+fourth sub-pixel 49W), and the luminance of the third primary color displayed by (third sub-pixel 49B+fourth sub-pixel 49W). In addition, the processes are performed so as to hold (maintain) their color tones. Moreover, the processes are performed so as to hold (maintain) their gradation-luminance characteristic (gamma characteristic or $\gamma$ characteristic).

When all the input signal values are "0" (or when they are small) in either one of the pixel and the pixel group, the extension coefficient $\alpha$ has only to be calculated without including the pixel or the pixel group.

Process-100

First of all, the signal processing section 20 calculates the saturation S and the brightness V(S) of each of the plurality of pixels based on the input signal values of sub-pixels in the plurality of pixels. Specifically, the signal processing section 20 calculates $S_{(p,\ q)}$ and $V(S)_{(p,\ q)}$ from Equations (12-1) and (12-2) respectively, based on the input signal value $x_{1-(p,\ q)}$ of the first sub-pixel input to the $_{(p,\ q)}$-th pixel, the input signal value $x_{2-(p,\ q)}$ of the second sub-pixel input thereto, and the input signal value $x_{3-(p,\ q)}$ of the third sub-pixel input thereto. The signal processing unit 20 performs the process on all the pixels.

Process-110

Then, the signal processing section 20 calculates an extension coefficient $\alpha(S)$ based on Vmax(S)/V(S) calculated in the pixels.

$$\alpha(S)=V\max(S)/V(S) \tag{14}$$

Values of the extension coefficient $\alpha(S)$ calculated in the plurality of pixels (all of $P_0\times Q_0$ pixels in the embodiment) are arranged in ascending order, and an extension coefficient $\alpha(S)$ corresponding to a range from the minimum value to $\beta\times P_0\times Q_0$, of the values of the $P_0\times Q_0$ extension coefficients $\alpha(S)$ is determined as an extension coefficient $\alpha$. In this way, the extension coefficient $\alpha$ can be determined so that a proportion of pixels, each in which the value of the extended brightness calculated from a product of the brightness V(S) and the extension coefficient $\alpha$ exceeds the maximum value Vmax(S), to all the pixels becomes a predetermined value ($\beta$) set with respect to a space according to the input signal, or less.

In the embodiment, the limit proportion value $\beta$ is preferably, for example, 0 to 0.2 (0% to 20%), more preferably 0.0001 to 0.20 (0.01% to 20%), and further more preferably 0.003 to 0.05 (0.3% to 5%). The values of $\beta$ are determined after conduction of various experiments.

When the minimum value of Vmax(S)/V(S) is set as the extension coefficient $\alpha$, the output signal value with respect to the input signal value never exceeds $(2^8-1)$. However, when the extension coefficient $\alpha(S)$ is determined in the above manner instead of determining the minimum value of Vmax(S)/V(S), a pixel whose extension coefficient $\alpha(S)$ is less than the extension coefficient $\alpha$ is multiplied by the extension coefficient $\alpha$, and the value of the extended brightness thereby exceeds the maximum value Vmax(S). As a result, so-called "gradation loss" occurs. However, by setting $\beta$ to, for example, 0.003 to 0.05 as explained above, it is possible to prevent occurrence of such phenomena that an image becomes an odd image due to visible gradation loss. On the other hand, when $\beta$ exceeds 0.05, it is recognized in some cases that an image becomes an odd image due to visible gradation loss. If the output signal value exceeds $(2^n-1)$ being the limit value due to the extension process, then the output signal value is simply set to $(2^n-1)$ being the limit value.

In general, values of the extension coefficient $\alpha(S)$ exceed 1.0, and many of them are concentrated close to 1.0. Therefore, if the minimum value of Vmax(S)/V(S) is set as the extension coefficient $\alpha$, then an extension degree of the output signal value is low, and it is therefore frequently difficult to achieve a lower power consumption of the display device. However, by setting, for example, $\beta$ as 0 to 0.2, the value of the extension coefficient $\alpha$ of at least a partial space can be increased, and, as explained later, the luminance of the planar light source device 50 is simply decreased by a factor of $(1/\alpha)$, thus enabling to achieve the lower power consumption of the display device.

Process-120

Next, the signal processing section 20 calculates the signal value $X_{4-(p,\ q)}$ of the (p, q)-th pixel based on at least the signal value $x_{1-(p,\ q)}$, the signal value $x_{2-(p,\ q)}$, and the signal value $x_{3-(p,\ q)}$. Specifically, in the embodiment, the signal value $X_{4-(p,\ q)}$ is determined based on $\mathrm{Min}_{(p,\ q)}$, the extension coefficient $\alpha$, and the constant $\chi$. More Specifically, in the embodiment, the signal value $X_{4-(p,\ q)}$ is determined in the above manner based on the following equation.

$$X_{4-(p,q)}=\mathrm{Min}_{(p,q)}\cdot\alpha/\chi \tag{11}$$

The signal value $X_{4-(p,\ q)}$ is calculated for each of all the $P_0\times Q_0$ pixels.

Process-130

Thereafter, the signal processing section 20 calculates the signal value $X_{1-(p,\ q)}$ of the $_{(p,\ q)}$-th pixel based on the signal value $x_{1-(p,q)}$, the extension coefficient $\alpha$, and the signal value $X_{4-(p,q)}$, calculates the signal value $X_{2-(p,q)}$ of the $_{(p,\ q)}$-th pixel based on the signal value $x_{2-(p,\ q)}$, the extension coefficient $\alpha$, and the signal value $X_{4-(p,\ q)}$, and calculates the signal value $X_{3-(p,\ q)}$ of the $_{(p,\ q)}$-th pixel based on the signal value $x_{3-(p,\ q)}$, the extension coefficient $\alpha$, and the signal value $X_{4-(p,\ q)}$. Specifically, the signal processing unit 20 calculates the signal value $X_{1-(p,\ q)}$, the signal value $X_{2-(p,\ q)}$, and the signal value $X_{3-(p,\ q)}$ of the $_{(p,\ q)}$-th pixel in the above manner based on the following equations.

$$X_{1-(p,q)}=\alpha\cdot x_{1-(p,q)}-\chi\cdot X_{4-(p,q)} \tag{1-1}$$

$$X_{2-(p,q)}=\alpha\cdot X_{2-(p,q)}-\chi\cdot X_{4-(p,q)} \tag{1-2}$$

$$X_{3-(p,q)}=\alpha\cdot X_{3-(p,q)}-\chi\cdot X_{4-(p,q)} \tag{1-3}$$

The signal processing unit 20 extends the value of $Min_{(p, q)}$ by α as illustrated in Equation (11). In this way, the value of $Min_{(p, q)}$ is extended by α, and this causes not only the luminance of a white display sub-pixel (fourth sub-pixel 49W) to be increased but also each luminance of a red display sub-pixel (first sub-pixel 49R), a green display sub-pixel (second sub-pixel 49G), and a blue display sub-pixel (third sub-pixel 49B) to be increased as illustrated in the equations. Therefore, such a problem that color dullness occurs can be surely avoided. In other words, as compared with the case in which the value of $Min_{(p, q)}$ is not extended, the value of $Min_{(p, q)}$ is extended by α and this causes the luminance to become α times higher as the entire image. Therefore, for example, an image such as a still image can be displayed with high luminance, which is the suitable method for this purpose.

The display device according to the embodiment extends the signal value $X_{1-(p, q)}$, the signal value $X_{2-(p, q)}$, the signal value $X_{3-(p, q)}$, and the signal value $X_{4-(p, q)}$ of the $_{(p, q)}$-th pixel by α times. Therefore, to make the luminance of an image the same as the luminance of an image which is not extended, the luminance of the planar light source device 50 has only to be decreased based on the extension coefficient α. Specifically, the luminance of the planar light source device 50 is simply decreased by a factor of (1/α). Thus, the power consumption of the planar light source device 50 can be reduced.

As explained above, the display device according to the embodiment divides the HSV color space into a plurality of spaces and sets the limit proportion value β with respect to each of the divided spaces, thus enabling to determine a value capable of reducing the power consumption as the extension coefficient while maintaining the image quality.

In the embodiment, the HSV color space is divided based on the hue and the saturation. In other words, a threshold is set in each of the hue and the saturation, and the HSV color space is divided into the spaces based on the threshold as a boundary; however, the embodiment is not limited thereto. The signal processing unit 20 has only to divide the HSV color space based on at least one of the hue, the saturation, and the brightness in the above manner. Therefore, the HSV color space may be divided based on one of three parameters: the hue, the saturation, and the brightness, or the HSV color space may be divided based on two of the parameters, or the HSV color space may be divided based on all the three parameters.

Figure 7:
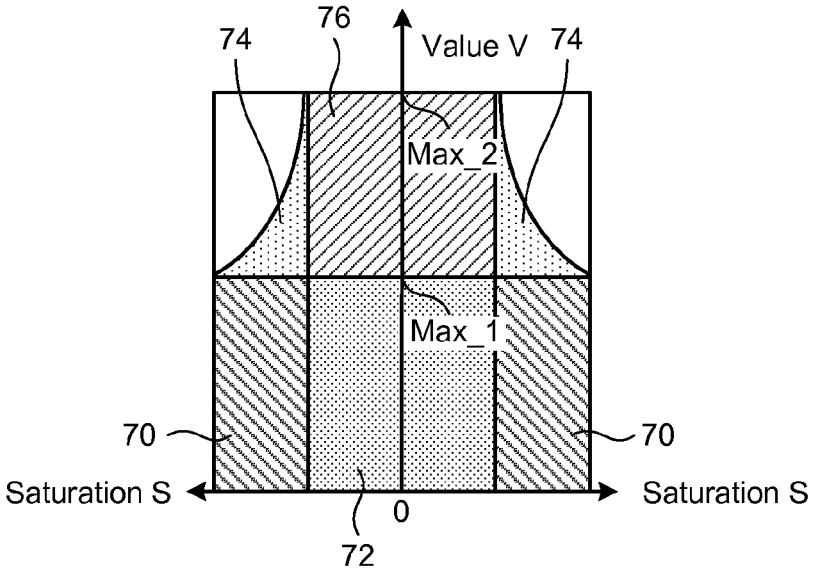
FIG. 7 is a conceptual diagram of a relation between the saturation and the brightness in the extended HSV color space.
Figure 8:
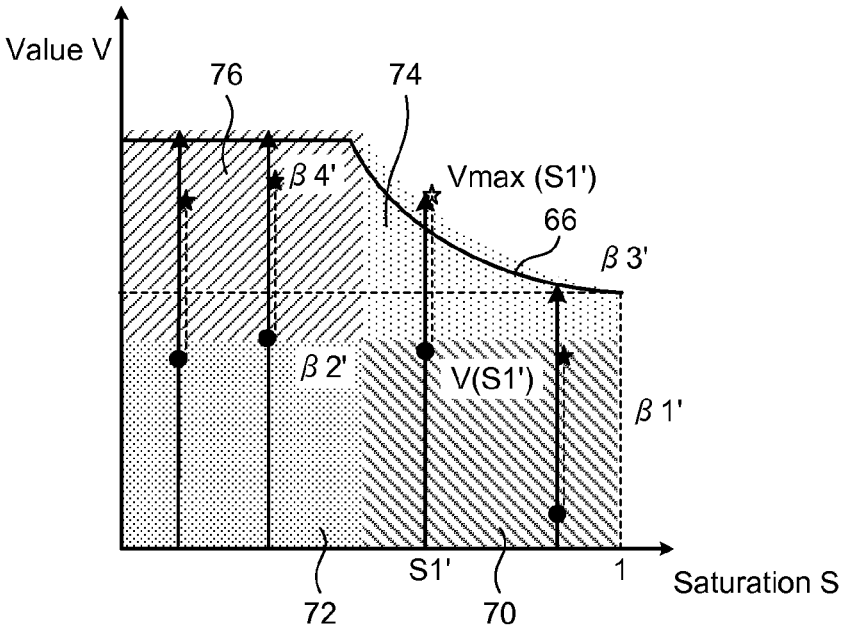
FIG. 8 is a conceptual diagram of a relation between the saturation and the brightness in the extended HSV color space.

An example of dividing the HSV color space (extended HSV color space) will be explained below with reference to FIG. 7 and FIG. 8. FIG. 7 is a conceptual diagram of a relation between the saturation and the brightness in the extended HSV color space. FIG. 8 is a conceptual diagram of a relation between the saturation and the brightness in the extended HSV color space. In the examples illustrated in FIG. 7 and FIG. 8, a limit proportion value β1' of a space 70 is set as 0.01 (1%), the space 70 being included in a range in which the hue H is 0°≤H<360°, the saturation S is 0.5≤S, and the brightness V is 0≤V≤Max_1. A limit proportion value β2' of a space 72 is set as 0.01 (1%), the space 72 being included in a range in which the hue H is 0°≤H<360°, the saturation S is S<0.5, and the brightness V is 0≤V≤Max_1. A limit proportion value β3' of a space 74 is set as 0.03 (3%), the space 74 being included in a range in which the hue H is 0°≤H<360°, the saturation S is 0.5≤S, and the brightness V is Max_1<V≤Max_2. A limit proportion value β4' of a space 76 is set as 0.03 (3%), the space 76 being included in a range in which the hue H is 0°≤H<360°, the saturation S is S<0.5, and the brightness V is Max_1<V≤Max_2.

In other words, in the examples illustrated in FIG. 7 and FIG. 8, the limit proportion value β is made different depending on whether the brightness V is included in 0≤V≤Max_1 or is not included in 0≤V≤Max_1 (i.e. it is Max_1<V≤Max_2). Therefore, as illustrated in FIG. 7 and FIG. 8, a relation of the limit value line indicating each value of the limit values to the maximum value line 66 indicating the maximum value of the brightness V varies between the space 70 (that is, the space within S≤0.5 and 0≤V≤Max_1) and the space 72 (that is, the space within 0.5<S and 0≤V≤Max_1), and the space 74 (that is, the space within S≤0.5 and Max_1<V≤Max_2) and the space 76 (that is, the space within 0.5<S and Max_1<V≤Max_2).

It is only necessary for the display device 10 to provide spaces obtained by dividing the extended HSV color space into a plurality of spaces and setting different limit proportion values with respect to each of at least two spaces of the divided spaces. Therefore, the display device 10 may provide a space in which a limit proportion value is not set with respect to a part of the extended HSV color space, that is, may provide a space not subjected to analysis upon calculation of the extension coefficient. The display device 10 can set a limit proportion value suitable for each space in spaces subjected to limitation without setting a limit proportion value with respect to a partial space, so that the effects can be obtained.

The display device 10 may be configured to provide a plurality of data indicating rules to divide the extended HSV color space into a plurality of spaces and information of limit proportion values set with respect to each of the divided spaces and to change data to be used. For example, the display device 10 may change the rules to divide the extended HSV color space to be used into spaces and the information of limit proportion values set with respect to each of the divided spaces depending on whether an image to be display is a moving image or a still image. The display device 10 may also change data to be used according to an environment to be used (whether the environment is indoor or outdoor or the environment is bright or dark).

Figure 9:
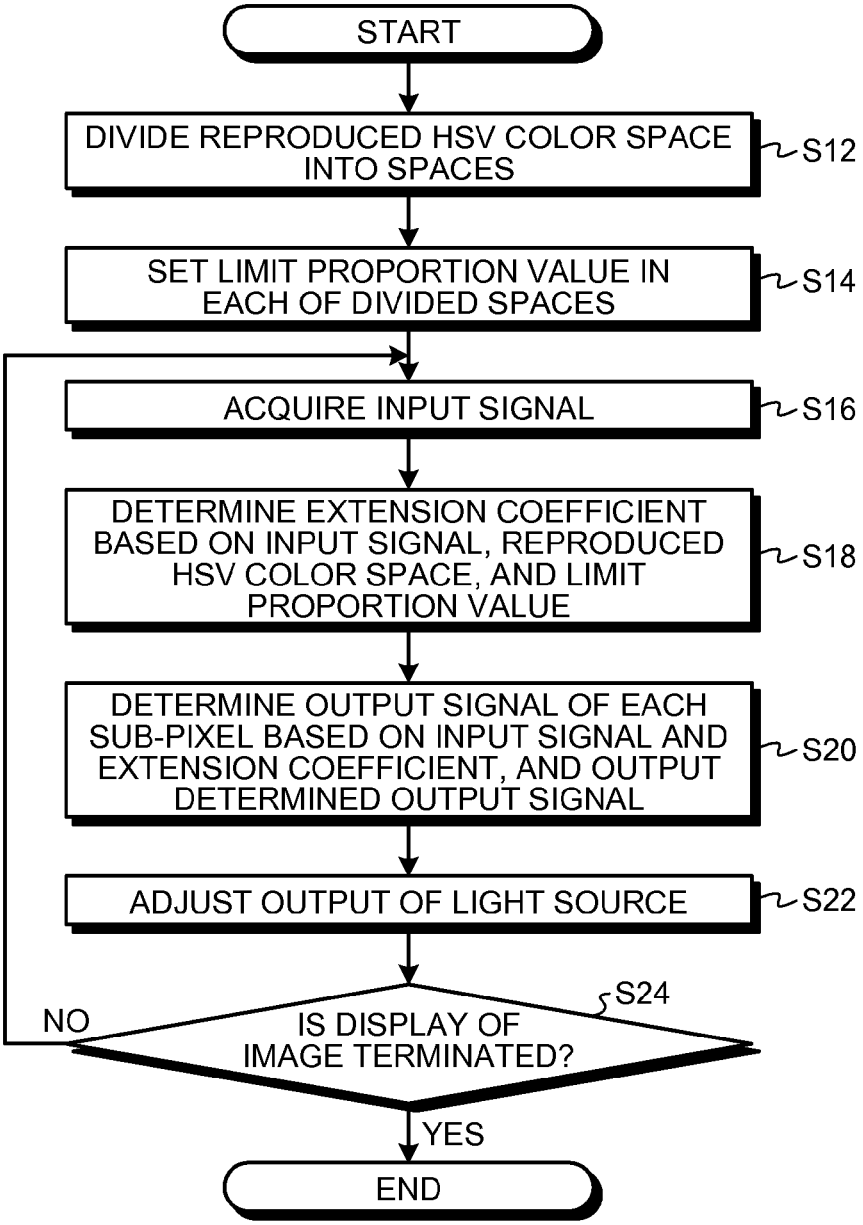
FIG. 9 is a flowchart of an example of a control operation of the display device.

An example of a control operation of the display device will be explained below with reference to FIG. 9. FIG. 9 is a flowchart of an example of a control operation of the display device. The display device 10 causes mainly the signal processing unit 20 to execute an arithmetic process, and thereby implements processes illustrated in FIG. 9.

The signal processing unit 20 divides the extended HSV color space into a plurality of spaces (Step S12), and sets a limit proportion value with respect to each of the divided spaces (Step S14). The signal processing unit 20 reads the stored data to perform division of the extended HSV color space and setting of limit proportion values.

After the setting of the limit proportion values, the signal processing unit 20 acquires an input signal (Step S16), and determines an extension coefficient based on the acquired input signal, the extended HSV color space (maximum value of the brightness), and a limit proportion value set with respect to a space according to the input signal (Step S18). Specifically, the signal processing unit 20 performs the processes as described above, and calculates the extension coefficient so that an extended output signal that exceeds the extended HSV color space (maximum value of the brightness) does not exceed the limit value (value obtained by multiplying the maximum value of the brightness by the limit proportion value).

Thereafter, the signal processing unit 20 determines an output signal of each sub-pixel based on the input signal and the extension coefficient (Step S20), and further adjusts an output of the light source (Step S22). That is, the signal processing unit 20 outputs the extended output signal to the image-display-panel drive circuit 40, and outputs conditions of output of the light source (planar light source device 50)

calculated corresponding to the result of extension, as the planar-light-source-device control signal, to the planar-light-source-device control circuit 60.

After the adjustment of the output of the light source, the signal processing unit 20 determines whether the display of the image is terminated (Step S24). When it is determined that the display of the image is not terminated (No at Step S24), then the signal processing unit 20 proceeds to Step S16. Thus, the signal processing unit 20 repeats the processes of determining an extension coefficient according to the input signal (image), generating an output signal based on the determined extension coefficient, and adjusting a light amount of the planar light source device 50 corresponding to the extension of the signal until the display of the image is terminated. When it is determined that the display of the image is terminated (Yes at Step S24), then the signal processing unit 20 ends the present process.

The signal processing unit 20 can obtain the above effects by performing the above processes. The signal processing unit 20 may provide a mode of displaying an image without using the fourth sub-pixel even if the fourth sub-pixel is provided therein.

2. Application Example

Figure 10:
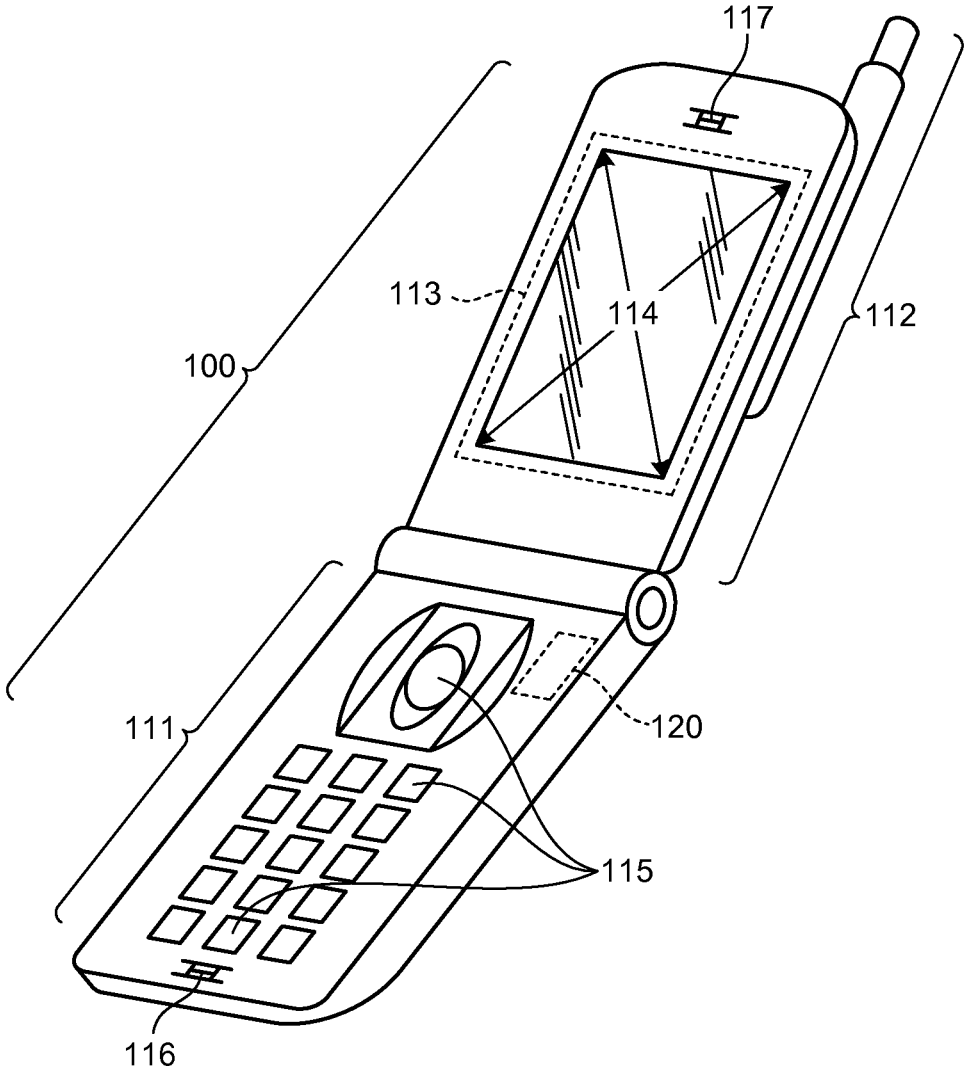
FIG. 10 is a perspective view of an example of a configuration of an electronic apparatus according to an application example.

An application example of the display device 10 according to the embodiment and its modification will be explained below. FIG. 10 is a perspective view of an example of a configuration of an electronic apparatus according to an application example. An electronic apparatus 100 is a mobile phone, and includes, as illustrated in FIG. 10, for example, a main body unit 111 and a display body unit 112 provided so as to be openable/closable with respect to the main body unit 111. The main body unit 111 has operation buttons 115 and a telephone transmitter unit 116. The electronic apparatus 100 also includes an internal control device 120 that controls the whole of the electronic apparatus 100. The display body unit 112 has a display device 113 and a telephone receiver unit 117. The display device 113 displays various types of indications related to telephone communication on a display screen 114 of the display device 113. The electronic apparatus 100 includes a control unit (not illustrated) for controlling operations of the display device 113. The control unit is provided inside the main body unit 111 or the display body unit 112, as part of the control device 120 or separately from the control device 120. The control device 120 that controls the whole of the electronic apparatus 100 supplies a video signal to the control unit of the display device 113. That is, the control device 120 determines a video displayed on the electronic apparatus 100 and sends a video signal of the determined video to the control unit of the display device 113, to thereby display the determined video on the display device 113.

The display device 113 has the same configuration as that of the display device 10 according to the embodiment and its modification. Accordingly, the lower power consumption can be achieved in the display device 113 while degradation of image quality is suppressed.

Examples of the electronic apparatus to which the display device 10 according to the embodiment and its modification can be applied include, but are not limited to, in addition to the mobile phone and the like, a clock with a display device, a wristwatch with a display device, a personal computer, a liquid crystal television, a viewfinder or a monitor-direct view video tape recorder, a car navigation device, a pager, an electronic notebook, an electric calculator, a word processor, a work station, a television telephone set, and a POS terminal unit.

Figure 11:
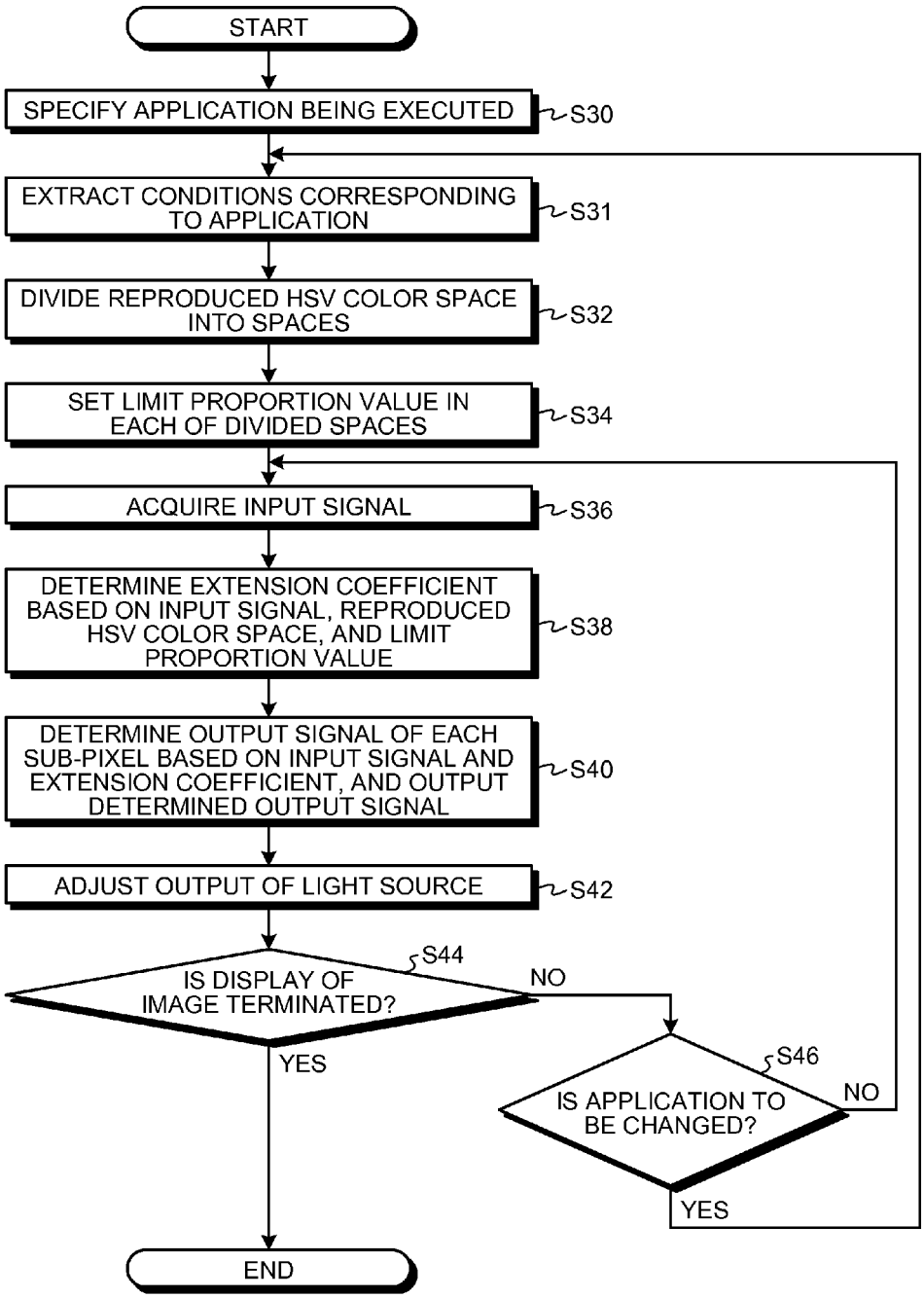
FIG. 11 is a flowchart of an example of a control operation of the electronic apparatus.

The electronic apparatus may change data (hereinafter, "conditions") indicating the rules to divide the extended HSV color space and the information for the limit proportion values set with respect to each of the divided spaces according to applications (software and functions) for displaying images. FIG. 11 is a flowchart of an example of a control operation of the electronic apparatus. The electronic apparatus 100 causes mainly the signal processing unit 20 and the control device 120 of the display device 113 to execute an arithmetic process, and thereby implements processes illustrated in FIG. 11.

The control device 120 specifies an application being executed (Step S30) and extracts conditions corresponding to the application (Step S31).

Subsequently, the display device 113 divides an extended HSV color space into a plurality of spaces (Step S32), and sets a limit proportion value with respect to each of the divided spaces (Step S34). The display device 113 reads the stored data to perform division of the color space and setting of the limit proportion values.

After the setting of the limit proportion values, the display device 113 acquires an input signal (Step S36), and determines an extension coefficient based on the acquired input signal, the extended HSV color space (maximum value of the brightness), and a limit proportion value set with respect to a space according to the input signal (Step S38). Specifically, the display device 113 performs the processes as described above, and calculates the extension coefficient so that an extended output signal that exceeds the extended HSV color space (maximum value of the brightness) does not exceed the limit value (value obtained by multiplying the maximum value of the brightness by the limit proportion value).

Thereafter, the display device 113 determines an output signal of each sub-pixel based on the input signal and the extension coefficient and outputs the determined output signal (Step S40), and further adjusts an output of the light source (Step S42). After the adjustment of the output of the light source, the display device 113 determines whether the display of the image is terminated (Step S44). When it is determined that the display of the image is not terminated (No at Step S44), the display device 113 determines whether the application is to be changed by the control device 120 (Step S46). When it is determined that the application is to be changed (Yes at Step S46), then the control device 120 proceeds to Step S31, and changes the conditions. When it is determined that the application is not to be changed (No at Step S46), then the control device 120 proceeds to Step S36. Thus, the display device 113 repeats the processes of determining an extension coefficient according to the input signal (image), generating an output signal based on the extension coefficient, and adjusting a light amount of the planar light source device corresponding to the extension of the signal until the display of the image is terminated. When the application is changed, then the electronic apparatus 100 can extend the input signal based on the conditions of the application. When it is determined that the display of the image is terminated (Yes at Step S44), then the display device 113 ends the present process.

The electronic apparatus 100 can obtain the above effects by performing the above processes. By changing the conditions corresponding to the change of the application, the electronic apparatus 100 can increase the extension coefficient when, for example, degradation of the image quality is accepted, and can reduce the extension coefficient when high image quality is requested. Thus, it is possible to further reduce power consumption while maintaining the image quality according to use application.

3. Aspects of Disclosure

The present disclosure includes the following aspects.

(1) A display device comprising:

an image display panel on which pixels each including a first sub-pixel for displaying a first color, a second sub-pixel for displaying a second color, a third sub-pixel for displaying a third color, and a fourth sub-pixel for displaying a fourth color are arranged in a two-dimensional matrix; and a signal processing unit that converts an input value of an input signal for an input HSV color space into an output signal for an extended HSV color space extended by the first color, the second color, the third color, and the fourth color to generate an output signal, and outputs the generated output signal to the image display panel, wherein the signal processing unit divides the extended HSV color space into a plurality of spaces based on at least one of a saturation, a brightness, and a hue, and sets limit proportion values different from each other with respect to at least two spaces of the divided spaces respectively, each of the limit proportion values being an upper limit of a proportion of a range exceeding a maximum value of the brightness to the maximum value in the extended HSV color space in a combination of values of the hue and the saturation, calculates an extension coefficient $\alpha$ with respect to the input signal within a range in which a first value does not exceed a second value, the first value being a value among values obtained by multiplying the brightness of a signal of each of the sub-pixels of the input signal by the extension coefficient $\alpha$, the first value exceeding the maximum value of the brightness, the second value being a value obtained by multiplying the maximum value of the brightness by a limit proportion value set with respect to a space according to the input signal, calculates an output signal of the first sub-pixel based on at least the input signal of the first sub-pixel and the extension coefficient $\alpha$, and outputs the calculated output signal to the first sub-pixel, calculates an output signal of the second sub-pixel based on at least the input signal of the second sub-pixel and the extension coefficient $\alpha$, and outputs the calculated output signal to the second sub-pixel, calculates an output signal of the third sub-pixel based on at least the input signal of the third sub-pixel and the extension coefficient $\alpha$, and outputs the calculated output signal to the third sub-pixel, and calculates an output signal of the fourth sub-pixel based on the input signal of the first sub-pixel, the input signal of the second sub-pixel, and the input signal of the third sub-pixel, and outputs the calculated output signal to the fourth sub-pixel.

(2) The display device according to (1), wherein the signal processing unit divides the extended HSV color space into two or more spaces based on the saturation.

(3) The display device according to (2), wherein the signal processing unit reduces a limit proportion value of a space in which the saturation is highest to a value less than a limit proportion value of a space in which the saturation is second highest.

(4) The display device according to (2), wherein the signal processing unit reduces a limit proportion value of a space in which the saturation is lowest to a value less than a limit proportion value of a space in which the saturation is second lowest.

(5) The display device according to (1), wherein the signal processing unit divides the extended HSV color space into two or more spaces based on the hue.

(6) The display device according to (1), wherein the signal processing unit divides the extended HSV color space into two or more spaces based on the brightness.

(7) The display device according to (1), wherein the signal processing unit sets the limit proportion values of the brightness with respect to each of the plurality of spaces of the extended HSV color space.

(8) The display device according to (1), wherein the signal processing unit includes a space in which the limit proportion values of the brightness is not set with respect to a part of the plurality of spaces of the extended HSV color space.

(9) The display device according to (1), wherein the fourth color is white.

(10) The display device according to (1), wherein the limit proportion values is 0 to 0.20.

(11) An electronic apparatus comprising:

a display device; and a control device, wherein the display device including:

an image display panel on which pixels each including a first sub-pixel for displaying a first color, a second sub-pixel for displaying a second color, a third sub-pixel for displaying a third color, and a fourth sub-pixel for displaying a fourth color are arranged in a two-dimensional matrix, and a signal processing unit that converts an input value of an input signal for an input HSV color space into an output signal for an extended HSV color space extended by the first color, the second color, the third color, and the fourth color to generate an output signal, and outputs the generated output signal to the image display panel, wherein the signal processing unit divides the extended HSV color space into a plurality of spaces based on at least one of a saturation, a brightness, and a hue, and sets limit proportion values different from each other with respect to at least two spaces of the divided spaces respectively, each of the limit proportion values being an upper limit of a proportion of a range exceeding a maximum value of the brightness to the maximum value in the extended HSV color space in a combination of values of the hue and the saturation, calculates an extension coefficient $\alpha$ with respect to the input signal within a range in which a first value does not exceed a second value, the first value being a value among values obtained by multiplying the brightness of a signal of each of the sub-pixels of the input signal by the extension coefficient $\alpha$, the first value exceeding the maximum value of the brightness, the second value being a value obtained by multiplying the maximum value of the brightness by a limit proportion value set with respect to a space according to the input signal, calculates an output signal of the first sub-pixel based on at least the input signal of the first sub-pixel and the extension coefficient $\alpha$, and outputs the calculated output signal to the first sub-pixel, calculates an output signal of the second sub-pixel based on at least the input signal of the second sub-pixel and the extension coefficient $\alpha$, and outputs the calculated output signal to the second sub-pixel, calculates an output signal of the third sub-pixel based on at least the input signal of the third sub-pixel and the extension coefficient α, and outputs the calculated output signal to the third sub-pixel, and calculates an output signal of the fourth sub-pixel based on the input signal of the first sub-pixel, the input signal of the second sub-pixel, and the input signal of the third sub-pixel, and outputs the calculated output signal to the fourth sub-pixel, and the control device supplies the input signal to the display device.

(12) A drive method executed by a display device including:

an image display panel on which pixels each including a first sub-pixel for displaying a first color, a second sub-pixel for displaying a second color, a third sub-pixel for displaying a third color, and a fourth sub-pixel for displaying a fourth color are arranged in a two-dimensional matrix, and a signal processing unit that converts an input value of an input signal for an input HSV color space into an output signal for an extended HSV color space extended by the first color, the second color, the third color, and the fourth color to generate an output signal, and outputs the generated output signal to the image display panel, the method comprising:

dividing the extended HSV color space into a plurality of spaces based on at least one of a saturation, a brightness, and a hue, and setting limit proportion values different from each other with respect to at least two spaces of the divided spaces respectively, each of the limit proportion values being an upper limit of a proportion of a range exceeding a maximum value of the brightness to the maximum value in the extended HSV color space in a combination of values of the hue and the saturation;

calculating an extension coefficient α with respect to the input signal within a range in which a first value does not exceed a second value, the first value being a value among values obtained by multiplying the brightness of a signal of each of the sub-pixels of the input signal by the extension coefficient α, the first value exceeding the maximum value of the brightness, the second value being a value obtained by multiplying the maximum value of the brightness by a limit proportion value set with respect to a space according to the input signal;

calculating an output signal of the first sub-pixel based on at least the input signal of the first sub-pixel and the extension coefficient α, and outputting the calculated output signal to the first sub-pixel;

calculating an output signal of the second sub-pixel based on at least the input signal of the second sub-pixel and the extension coefficient α, and outputting the calculated output signal to the second sub-pixel;

calculating an output signal of the third sub-pixel based on at least the input signal of the third sub-pixel and the extension coefficient α, and outputting the calculated output signal to the third sub-pixel; and calculating an output signal of the fourth sub-pixel based on the input signal of the first sub-pixel, the input signal of the second sub-pixel, and the input signal of the third sub-pixel, and outputting the calculated output signal to the fourth sub-pixel.

According to the display device, the electronic apparatus provided with the display device, and the drive method for the display device according to the present disclosure, by dividing the extended HSV color space into a plurality of spaces and setting different values for limit proportion values, power consumption can be reduced while degradation of image quality is suppressed.

It should be understood that various changes and modifications to the presently preferred embodiments described herein will be apparent to those skilled in the art. Such changes and modifications can be made without departing from the spirit and scope of the present subject matter and without diminishing its intended advantages. It is therefore intended that such changes and modifications be covered by the appended claims.

The invention claimed is:

1. A display device comprising:

an image display panel on which pixels each including a first sub-pixel for displaying a first color, a second sub-pixel for displaying a second color, a third sub-pixel for displaying a third color, and a fourth sub-pixel for displaying a fourth color are arranged in a two-dimensional matrix; and a signal processing unit that converts an input value of an input signal for an input HSV color space into an output signal for an extended HSV color space extended by the first color, the second color, the third color, and the fourth color to generate an output signal, and outputs the generated output signal to the image display panel, wherein the signal processing unit divides the extended HSV color space into a plurality of spaces based on at least one of a saturation, a brightness, and a hue, and sets limit proportion values different from each other with respect to at least two spaces of the divided spaces respectively, each of the limit proportion values being an upper limit of a proportion of a range exceeding a maximum value of the brightness to the maximum value in the extended HSV color space in a combination of values of the hue and the saturation, calculates an extension coefficient α with respect to the input signal within a range in which a first value does not exceed a second value, the first value being a value among values obtained by multiplying the brightness of a signal of each of the sub-pixels of the input signal by the extension coefficient α, the first value exceeding the maximum value of the brightness, the second value being a value obtained by multiplying the maximum value of the brightness by a limit proportion value set with respect to a space according to the input signal, calculates an output signal of the first sub-pixel based on at least the input signal of the first sub-pixel and the extension coefficient α, and outputs the calculated output signal to the first sub-pixel, calculates an output signal of the second sub-pixel based on at least the input signal of the second sub-pixel and the extension coefficient α, and outputs the calculated output signal to the second sub-pixel, calculates an output signal of the third sub-pixel based on at least the input signal of the third sub-pixel and the extension coefficient α, and outputs the calculated output signal to the third sub-pixel, and calculates an output signal of the fourth sub-pixel based on the input signal of the first sub-pixel, the input signal of the second sub-pixel, and the input signal of the third sub-pixel, and outputs the calculated output signal to the fourth sub-pixel.

2. The display device according to claim 1, wherein the signal processing unit divides the extended HSV color space into two or more spaces based on the saturation.

3. The display device according to claim 2, wherein the signal processing unit reduces a limit proportion value of a space in which the saturation is highest to a value less than a limit proportion value of a space in which the saturation is second highest.

4. The display device according to claim 2, wherein the signal processing unit reduces a limit proportion value of a space in which the saturation is lowest to a value less than a limit proportion value of a space in which the saturation is second lowest.

5. The display device according to claim 1, wherein the signal processing unit divides the extended HSV color space into two or more spaces based on the hue.

6. The display device according to claim 1, wherein the signal processing unit divides the extended HSV color space into two or more spaces based on the brightness.

7. The display device according to claim 1, wherein the signal processing unit sets the limit proportion values of the brightness with respect to each of the plurality of spaces of the extended HSV color space.

8. The display device according to claim 1, wherein the signal processing unit includes a space in which the limit proportion values of the brightness is not set with respect to a part of the plurality of spaces of the extended HSV color space.

9. The display device according to claim 1, wherein the fourth color is white.

10. The display device according to claim 1, wherein the limit proportion values is 0 to 0.20.

11. An electronic apparatus including a display device and a control device, the display device comprising:

an image display panel on which pixels each including a first sub-pixel for displaying a first color, a second sub-pixel for displaying a second color, a third sub-pixel for displaying a third color, and a fourth sub-pixel for displaying a fourth color are arranged in a two-dimensional matrix, and a signal processing unit that converts an input value of an input signal for an input HSV color space into an output signal for an extended HSV color space extended by the first color, the second color, the third color, and the fourth color to generate an output signal, and outputs the generated output signal to the image display panel, wherein the signal processing unit divides the extended HSV color space into a plurality of spaces based on at least one of a saturation, a brightness, and a hue, and sets limit proportion values different from each other with respect to at least two spaces of the divided spaces respectively, each of the limit proportion values being an upper limit of a proportion of a range exceeding a maximum value of the brightness to the maximum value in the extended HSV color space in a combination of values of the hue and the saturation, calculates an extension coefficient $\alpha$ with respect to the input signal within a range in which a first value does not exceed a second value, the first value being a value among values obtained by multiplying the brightness of a signal of each of the sub-pixels of the input signal by the extension coefficient $\alpha$, the first value exceeding the maximum value of the brightness, the second value being a value obtained by multiplying the maximum value of the brightness by a limit proportion value set with respect to a space according to the input signal, calculates an output signal of the first sub-pixel based on at least the input signal of the first sub-pixel and the extension coefficient $\alpha$, and outputs the calculated output signal to the first sub-pixel, calculates an output signal of the second sub-pixel based on at least the input signal of the second sub-pixel and the extension coefficient $\alpha$, and outputs the calculated output signal to the second sub-pixel, calculates an output signal of the third sub-pixel based on at least the input signal of the third sub-pixel and the extension coefficient $\alpha$, and outputs the calculated output signal to the third sub-pixel, and calculates an output signal of the fourth sub-pixel based on the input signal of the first sub-pixel, the input signal of the second sub-pixel, and the input signal of the third sub-pixel, and outputs the calculated output signal to the fourth sub-pixel, and the control device supplies the input signal to the display device.

12. A drive method of a display device including an image display panel on which pixels each including a first sub-pixel for displaying a first color, a second sub-pixel for displaying a second color, a third sub-pixel for displaying a third color, and a fourth sub-pixel for displaying a fourth color are arranged in a two-dimensional matrix, and a signal processing unit that converts an input value of an input signal for an input HSV color space into an output signal for an extended HSV color space extended by the first color, the second color, the third color, and the fourth color to generate an output signal, and outputs the generated output signal to the image display panel, the method comprising:

dividing the extended HSV color space into a plurality of spaces based on at least one of a saturation, a brightness, and a hue, and setting limit proportion values different from each other with respect to at least two spaces of the divided spaces respectively, each of the limit proportion values being an upper limit of a proportion of a range exceeding a maximum value of the brightness to the maximum value in the extended HSV color space in a combination of values of the hue and the saturation;

calculating an extension coefficient $\alpha$ with respect to the input signal within a range in which a first value does not exceed a second value, the first value being a value among values obtained by multiplying the brightness of a signal of each of the sub-pixels of the input signal by the extension coefficient $\alpha$, the first value exceeding the maximum value of the brightness, the second value being a value obtained by multiplying the maximum value of the brightness by a limit proportion value set with respect to a space according to the input signal;

calculating an output signal of the first sub-pixel based on at least the input signal of the first sub-pixel and the extension coefficient $\alpha$, and outputting the calculated output signal to the first sub-pixel;

calculating an output signal of the second sub-pixel based on at least the input signal of the second sub-pixel and the extension coefficient $\alpha$, and outputting the calculated output signal to the second sub-pixel;

calculating an output signal of the third sub-pixel based on at least the input signal of the third sub-pixel and the extension coefficient $\alpha$, and outputting the calculated output signal to the third sub-pixel; and calculating an output signal of the fourth sub-pixel based on the input signal of the first sub-pixel, the input signal of the second sub-pixel, and the input signal of the third sub-pixel, and outputting the calculated output signal to the fourth sub-pixel.

* * * * *